US006541692B2

(12) United States Patent
Miller

(10) Patent No.: US 6,541,692 B2
(45) Date of Patent: Apr. 1, 2003

(54) DYNAMICALLY ADJUSTABLE NETWORK ENABLED METHOD FOR PLAYING ALONG WITH MUSIC

(76) Inventor: Allan Miller, 167 Rideout Rd., Hollis, NH (US) 03049

( * ) Notice: Subject to any disclaimer, the term of this patent is extended or adjusted under 35 U.S.C. 154(b) by 0 days.

(21) Appl. No.: 09/894,867

(22) Filed: Jun. 28, 2001

(65) Prior Publication Data

US 2002/0005109 A1 Jan. 17, 2002

Related U.S. Application Data

(60) Provisional application No. 60/216,825, filed on Jul. 7, 2000.

(51) Int. Cl.[7] ..... G10H 1/22; G10H 1/36; G10H 1/42

(52) U.S. Cl. ..... 84/634; 84/649; 84/656; 84/668; 84/477 R; 84/DIG. 2

(58) Field of Search ..... 84/609–614, 618, 84/634–638, 649–652, 656, 666–669, DIG. 2, 477 R, 478

(56) References Cited

U.S. PATENT DOCUMENTS

| | | | | | |
|---|---|---|---|---|---|
| 5,393,926 | A | | 2/1995 | Johnson | 84/610 |
| 5,449,857 | A | * | 9/1995 | Ohshima | 84/618 |
| 5,491,297 | A | | 2/1996 | Johnson et al. | 84/609 |
| 5,585,585 | A | * | 12/1996 | Paulson et al. | 84/610 |
| 5,670,729 | A | | 9/1997 | Miller et al. | 84/609 |
| 5,723,802 | A | | 3/1998 | Johnson et al. | 84/609 |
| 6,075,193 | A | * | 6/2000 | Aoki et al. | 84/609 |
| 6,103,964 | A | | 8/2000 | Kay | 84/611 |
| 6,121,532 | A | | 9/2000 | Kay | 84/611 |
| 6,121,533 | A | | 9/2000 | Kay | 84/616 |
| 6,143,971 | A | * | 11/2000 | Aoki et al. | 84/609 |
| 6,225,546 | B1 | * | 5/2001 | Kraft et al. | 84/609 |
| 6,225,547 | B1 | * | 5/2001 | Toyama et al. | 84/611 |
| 6,342,665 | B1 | * | 1/2002 | Okita et al. | 84/609 |

FOREIGN PATENT DOCUMENTS

| | | |
|---|---|---|
| EP | 0 903 169 A2 | 3/1999 |
| JP | 2922509 | 6/1999 |

* cited by examiner

*Primary Examiner*—Stanley J. Witkowski
(74) *Attorney, Agent, or Firm*—Hamilton, Brook, Smith & Reynolds, P.C.

(57) ABSTRACT

Many non-musicians enjoy listening to music, and would like to be able to play along with it, but do not have the talent or the time to learn to play a musical instrument. The system described herein allows non-musicians to follow along with a display that is based on the principles of musical notation, but is designed to be intuitive and require no training to use. The player is guided through the steps of playing a rhythm along with a musical performance, and the system provides the illusion that the player is actually playing a melodic part on an instrument. In addition, the system indicates how closely the player is following the guide, and it also scores the player's performance. The score is used to drive interactive feedback to the player. The system can be configured to work in local area networks or wide area networks with low latency or high latency in the network. This system is ideally suited for video arcade games, home entertainment devices, dedicated toy applications, music education, Internet entertainment applications, and other uses.

19 Claims, 15 Drawing Sheets

FIG. 4

Song element

- next song element — 61
- repeat count — 62
- element length — 63
- tempo adjustment — 64
  - start / end array — 65
- key adjustment — 66
- alternate song element — 67
- element index — 68
- definition (element / pattern) — 69

DYNAMICALLY ADJUSTABLE NETWORK ENABLED METHOD FOR PLAYING ALONG WITH MUSIC

RELATED APPLICATION

This application claims the benefit of U.S. Provisional Application No. 60/216,825, filed on Jul. 7, 2000. The entire teachings of the above application is incorporated herein by reference.

BACKGROUND OF THE INVENTION

For a long time, electric organs have incorporated features that automate some aspect of playing music to make it easier for a novice musician to play music that sounds pleasing. These devices can play a rhythm track, or play an entire accompaniment selected by a single key. They can also provide more control by allowing the player to play the significant notes of the accompaniment, while automatically "filling in" and voicing the chords appropriately. However, these devices typically require at least some practice on the part of the player, and are therefore not suited to casual or one-time use by non-musicians.

Other devices are similar in function, but are designed for use by professional musicians. These typically are set up as MIDI sequencers with advanced controls that can be manipulated from a variety of input devices. A performer can use them to automate the generation of accompaniment music, or even whole melodies, while still allowing the flexibility to alter the performance while it is happening. These devices allow a single performer, such as a nightclub entertainer, to play nearly arbitrary requests from the audience, and still maintain a full sound, while not requiring an entire band of musicians. However, the complexity of control of these devices, and the potential for error that they introduce, take them out of the realm of entertainment machines designed for non-musicians.

Music learning devices have been created that allow a student to play along with either written or pre-recorded music, measure some aspect of the student's performance, and provide feedback on the quality of the performance. These devices typically run on a general-purpose computer, and use input controllers that either closely mimic the operation of an actual musical instrument, or are actually the instrument. By definition, they are designed for non-musicians to use (at least for the initial lessons), but they usually require some commitment of effort, and are not really entertaining enough to be attractive for casual or one-time use. In addition, they typically are not set up to sound good when the player plays incorrectly, since the point is to educate the student to play correctly.

Another professional device exists that uses the chord structure of the music to set up the keyboard so that it only plays notes that are part of the scale currently in use. This allows the player to improvise against the music more easily. A consumer version of this product exists that is implemented on a general-purpose computer. However, without any musical training, the improvisations that a player creates tend to be either monotonous or bizarre.

Some modern forms of music are based primarily on sampling, where short audio segments are played in rhythm to a backing track. As a result, some toys and other consumer products exist that allow non-musicians to select and play samples while a backing track is playing. Once again, without any musical training, the rhythmic improvisation produced by a novice tends to be fairly monotonous.

A device exists that allows non-musicians to control a melody that is automatically generated and played along with a pre-recorded accompaniment. By using a joystick or mouse input device, the player can control the general pitch (higher and lower) of the melody, as well as the density of notes in it. This device, which is implemented using a general-purpose computer, does not provide the player with the immediate tactile feedback that creates the illusion of playing an actual musical instrument.

An entertainment device exists that provides a display for a non-musician to follow and strum a guitar-like instrument or play a drum-like instrument. As a result, the device generates a musical part that is played along with a pre-recorded accompaniment. The player is rated on the accuracy of the performance, and the rating is used to control various responses of the machine. This device is again implemented using a general-purpose computer. However, this device uses a single part for an entire song, making it difficult to adjust the part dynamically to adapt to the skill of the player. In addition, the musical part is created as a single unit, making it relatively difficult and expensive to add new songs to the repertoire.

Several popular Japanese arcade games also provide a display for a non-musician to follow, and use a simple input device to play a generated musical part along with a pre-recorded accompaniment. These games are very similar to the entertainment device just described, and subsequently, include the same shortcomings.

Multiple musicians at disparate geographic locations have played together using computer networks to transmit performance information to each other. However, this has been done by musicians in constrained environments using low latency networks.

SUMMARY OF THE INVENTION

The present invention enables a non-musician to produce reasonable music without any prior training. The invention relates to systems that allow individuals with limited or no musical experience to play along with pre-recorded music in an entertaining way. The invention allows a complete novice to use an extremely simple input device to play a part that fits in well with a harmonious background music part. The invention is instantly accessible to a beginner, and produces a reasonable-sounding part regardless of the skill of the player. The present invention provides the player with a guide to follow, and organizes the guide in the same conceptual way that music is organized. The guide of the present invention gives the player something to follow, and the automated note selection of the invention avoids the monotony that occurs in sampling devices when a player repeatedly selects the same sample.

In addition, the present invention contains a display that provides guidance to the player rather than relying on the player's ability to improvise. The present invention represents the part of the player as segments that are dynamically composed as the song is playing. This allows various parameters of the player's part (such as difficulty) to be adjusted during play without degrading the quality of the part. It also allows parts for new songs to be quickly and easily composed using the library of existing segments. The present invention also allows non-musicians to play together using a public network with high and/or variable latency characteristics.

A system and method to allow a person with no formal music training to play along with an existing musical song provides an entertaining experience for non-musicians who nonetheless have an interest in and enjoy music. The system defined here uses any computing device capable of generating musical tones and acting in response to input from a user. The process used to define the part that is played by the non-musician player is very similar to the process used to compose music, and as a result, can be manipulated as the song progresses to produce interesting variations of the part.

The computing device provides the user with a multimedia (sound and video) presentation of a musical performance. In addition, it uses algorithmically generated graphics to present the user with an intuitive display indicating when the user should be playing a rhythmic passage to go along with the musical performance. Following this display, the user manipulates one or more input peripherals that are designed to capture rhythmic actions such as tapping one's fingers, hitting with a stick, tapping one's feet, moving one's body, singing, blowing into a tube, dancing, or strumming taut strings. These actions are converted into a series of time-based signals that are transmitted to the computing device, which then algorithmically determines a set of musical tones to play in response to the actions. These musical tones fit in with the musical performance, and since they are played at the same time as the actions of the user, the user perceives that those actions are creating the musical tones. This provides the illusion that the user is playing along with the musical performance.

Since the computing device can have an interface to a computer network, the system can be used to implement interaction with multiple players, analogous in many ways to a band formed with individual musical instruments. In situations where the players are physically located near each other, a local area dedicated network with low latency is used, the multiple computing devices are synchronized, and the resulting synthesized parts can be heard by all players in a true cooperative "band". In situations where the players are geographically disparate, a wide area public network is used. When the latency is high, the individual players cannot be synchronized, but since they cannot hear each other, this is less important. The characteristics of each of the players' actions are transmitted to all other players with relatively low bandwidth, and the actual result of all the players working together is synthesized for each player by their individual computing device. The actual performance is also recorded and distributed so that each player can review it and discuss it after the fact.

The display indicating what should be played is loosely based on standard musical notation, but the present invention simplifies it by displaying each note as a bar, with the length of the bar indicating the duration of the note. One indicator moves from bar to bar, showing which note the user should be playing. Another indicator moves along each bar, showing how long ago the note was played, and also showing how much time is left until the next note must be played. This display is very intuitive and simple to follow, and lends itself well to many adaptations in presentation to keep it interesting and fresh for the player.

When the player plays a note, the computing device uses a sound synthesis unit to generate a musical tone. The selection of which tone to generate is done by a stored representation of the player's performance. This stored representation uses a structure that models the way musicians actually think about musical performances. It is a hierarchical description, corresponding to the decomposition of a song into units such as sections, phrases, measures, and notes. It has a mechanism for describing repetition, so that constructs such as repeated verses are conveniently specified. It can describe tempo change and key modulation, independent from the song structure and decomposition. It has a way to indicate multiple possibilities for the same unit of the song, in much the same way that musical improvisation typically consists of organizing pre-defined patterns into an interesting overall performance.

Since the computing device has information about both what the user is supposed to play and what the user is actually playing, it can algorithmically generate information about how well the user is playing. By using the accuracy of the player's performance, in conjunction with a scoring algorithm, to generate a score, he computing device drives interactive feedback to indicate how well the player is playing. This measurement can be based on both the rhythmic accuracy of the performance as well as the accuracy of playing the correct selection of multiple input peripherals as indicated on the display. The correct selection of multiple input peripherals can be the correct tones played by a user on an input peripheral, for example. The device also uses this score to drive the decisions made by the note generation mechanism, so that the difficulty and variety of the parts available to the player increase as the player improves. The score is also used to drive decisions on a larger scale, such as what options the player has in terms of the available songs or the scenes that can be accessed in a game application.

The scoring mechanism is important for computer network implementations of multi-player applications. It is the fundamental mechanism for competition between multiple players, since it provides an objective measure for comparison. It also provides the mechanism for overcoming network latencies. The scoring mechanism computes higher order statistics of the player's performance relative to the guide, which are sent across the network and used to drive a predictive model of the player's performance. In this way, in a high latency network, each player does not hear the exact performance of the other players, but does hear a "representative" performance that gives nearly the same score as the actual performance. Later on, after the entire song has been performed, the actual combined performance is available to all players for review.

The present invention is ideally suited for use in game applications in several ways. These are described here.

The scoring mechanism is vital for a game. It allows players to compete, either with other players, their prior scores, or virtual (computer-generated) characters. It also allows immediate feedback (visual, auditory, touch, and even other sensory feedback) on the player's performance. For example, a crowd can react with varying amounts of cheering or booing depending on the score. Finally, aggregate scores are used to drive major decision points in a game. For example, a game that is organized as several "levels" will not allow the player to proceed to the next level until a certain score is attained, and higher scores are required for later levels.

The graphical display showing the user what to play is also well suited for game applications. Its constantly changing nature and composition of simple discrete graphic elements are characteristics of "status" displays that are part of nearly every game. In addition, these same elements lend themselves perfectly to alternate graphical representations that are more integrated with the game. For example, the bars could be represented as three-dimensional solids lined up in a row, and the indicator for the note that was last played could be represented by a character standing on the bar (the character would jump from bar to bar as notes were played). The indicator moving along the bar could be represented by the next bar moving down alongside the current bar, so that the player would attempt to make the character jump from one bar to the next when the tops of the two bars are even.

The ability of the present invention to incorporate many different kinds of input peripherals increases its attractiveness for arcade game implementations. Recent arcade games tend to use novel input devices as a distinguishing feature. Since the actual amount of information required from the peripherals is about the same as that provided by a push-button, a large variety of robust and inexpensive peripherals will work with the system.

The capability to actively use input from several players, either closely located or widely separated, is rapidly becoming a critical factor in the utility of technology for game applications (and other entertainment products as well). The rapid acceptance of the Internet has made multi-player gaming nearly a requirement for new games. In addition, more and more arcade games have multi-player stations as a distinguishing feature. The present invention addresses all of these issues, by providing applications for wide area networks as well as local area networks, high latency networks as well as The ability to generate different parts for the user to play is extremely important for the "replay" value of a game application. In both arcade and console games, a high premium is placed on games that get players to come back and play the game again many times. By representing the player's performance as a hierarchical structure with options and repetition in the hierarchy, the present invention provides nearly unlimited variety in the parts played by the player, in a way that makes sense musically and is logical to the player. This variety avoids a problem where the player ends up doing the same thing over, and also allows the player to have some control over what happens, opening up the exciting world of musical improvisation (in a limited but very real sense).

The ability to modify the parts played by the user dynamically is an even further extension that adds to this "replay" value. Since the computing device can select alternate parts in the hierarchy for the player to perform, this decision can be based on how well the player is doing, and the game will then actively respond to the player's skill level. By getting more difficult at a rate that makes sense to the player, the game encourages additional play to master the increased difficulty.

In this way, the invention provides an enjoyable experience to non-musicians, allowing them to play along with music without additional talent or training. The principles of the invention can be extended in many ways and applied to many different environments, as will become apparent in the following description of the preferred embodiment.

A preferred embodiment of the invention relates to a music system having a peripheral, a hierarchical music data structure that represents the music to be played by a user, a digital processor and recorded music data that forms the accompanying music to which the user plays. The peripheral generates a signal in response to activation of the peripheral by a user. The digital processor receives the signal from the peripheral and drives an audio synthesizer based upon the signal.

The hierarchical structure can include at least one structural component and at least one pattern. The at least one structural component can include a plurality of alternative structural components while the at least one pattern can include a plurality of alternative patterns. The alternative structural components and the alternative patterns can include a plurality of difficulty levels. These difficulty levels can include a first difficulty level and a second difficulty level where the second difficulty level is more difficult that the first difficulty level.

The system can include a synchronizer that synchronizes the digital processor to the recorded music data. The music system can also include a scoring algorithm to generate a score based upon the correspondence between the signal generated by the user's activation of the peripheral and the music represented by the hierarchical music data structure. This score is then used to activate a corresponding difficulty level. Alternately, a randomization algorithm can be used to determine the difficulty level within the music system.

The music system can also include a modification data structure that can be used to adjust a tempo within the hierarchical music data structure or to adjust a musical key within the hierarchical music data structure.

The music system can include a display for guiding a user in activating a peripheral device corresponding to the hierarchical music data structure. The display can include a first axis showing successive notes within the hierarchical music data structure and a second axis corresponding to the duration of notes within the hierarchical music data structure. The display can also include a first indicator that increments along the first axis to indicate to a user the note within the hierarchical music data structure to be played and a second indicator that moves along the second axis to indicate to a user the duration of the note within the hierarchical music data structure to be played.

The music system can include a local area network or a wide area network allowing for connection of a plurality of music systems. The system having a wide area network can include a statistical sampler and a predictive generator, the statistical sampler generating n-th order statistics relative to activation of the peripheral. The statistics are sent by the wide area network to the predictive generator that generates a performance based on the statistics from the statistical sampler, independent of the latency of the network. The system can also include a virtual peripheral connected to the predictive generator, such that the predictive generator drives the virtual peripheral to generate a performance. A broadcast medium can be used for transmission of recorded music data over the wide area network.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4 illustrates the data structure for a song element;

DETAILED DESCRIPTION OF THE INVENTION

Figure 1:
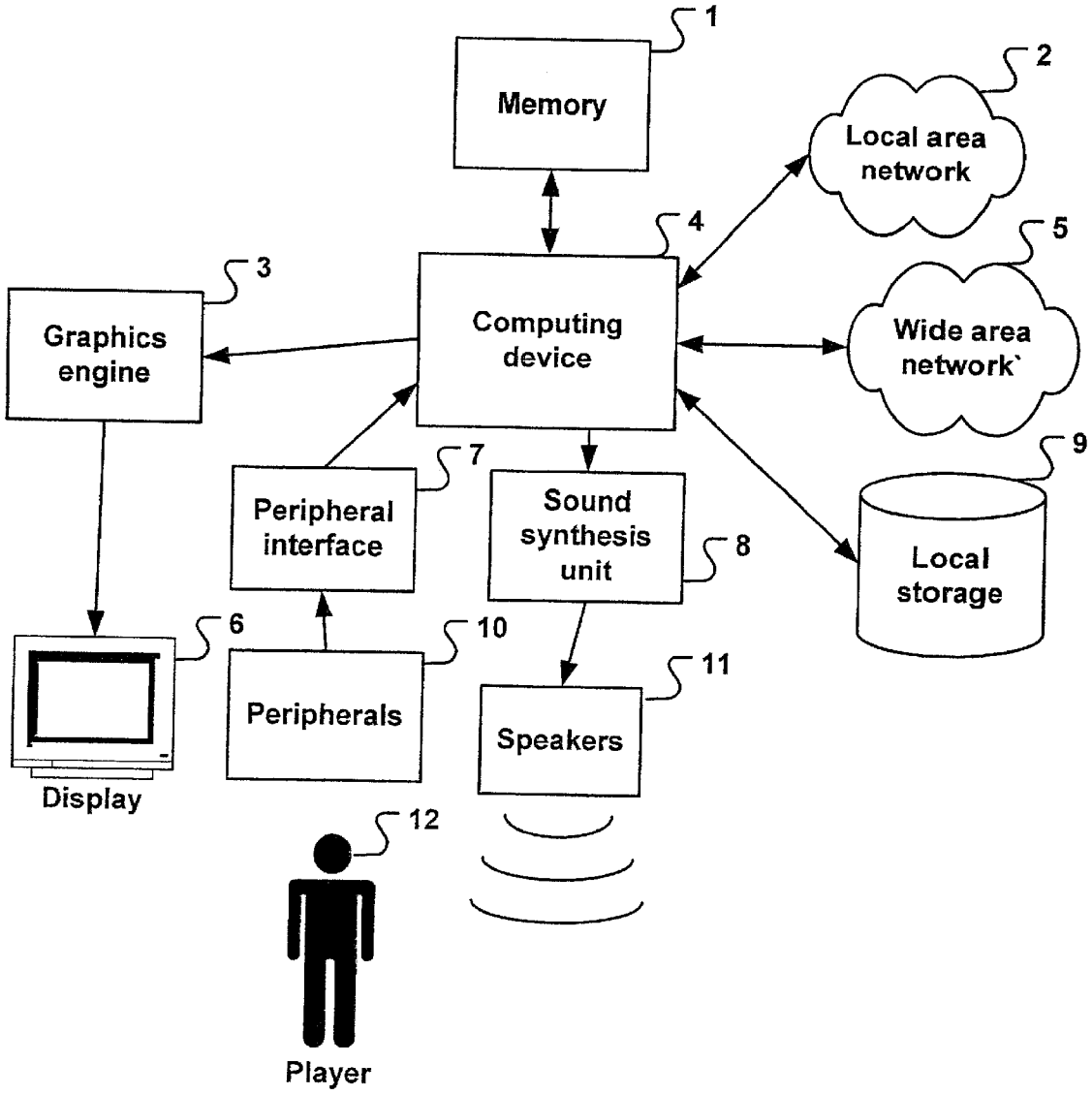
FIG. 1 is a block diagram of the overall system.

FIG. 1 shows an overview of the music system. A computing device 4 manages the overall system. A player 12 watches a display 6 for visual cues, and listens to speakers 11 for audio cues. Based on this feedback, the player 12 uses peripherals 10 to play a rhythm that corresponds to a musical performance being played by a digital processor such as a computing device 4 through a sound synthesis unit 8 and speakers 11. The peripherals 10 provide input to the computing device 4 through a peripheral interface 7. Based on player performance information stored on local storage 9 and kept in memory 1, the computing device 4 uses signals from the peripheral interface 7 to drive the generation of musical tones by the sound synthesis unit 8 and play them through speakers 11. The player 12 hears these tones, completing the illusion that he or she has directly created these tones by playing on the peripherals 10. The computing device 4 uses a graphics engine 3 to generate a display 6 to further guide and entertain the player 12. The computing device 4 can be connected to other computing devices performing similar functions through a local area network 2 or a wide area network 5. Note that FIG. 1 is meant to be illustrative, and there are other configurations of computing devices that can be described by one skilled in the art. For example, a multiple processor configuration could be used to drive the system.

Figure 2:
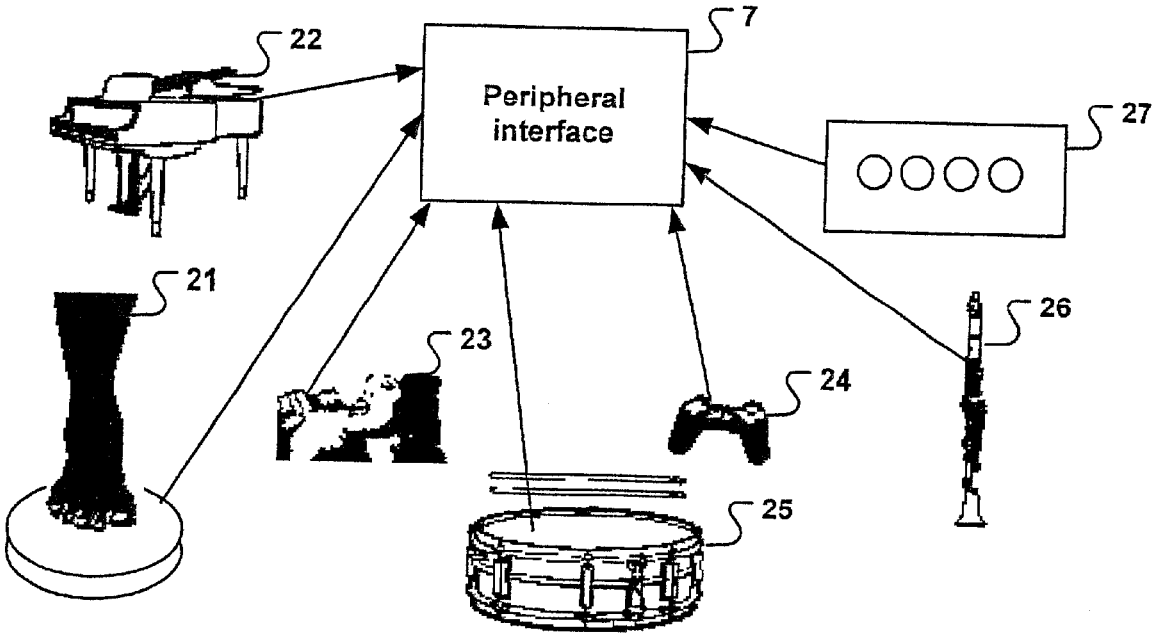
FIG. 2 illustrates example user interface elements.

Referring to FIG. 2, a number of different kinds of peripherals can be used to drive the peripheral interface 7. Some representative examples are a foot-operated pad 21, an electronic keyboard 22, a voice-operated microphone 23, a standard game controller 24, an instrument shaped like a drum 25, an instrument shaped like a wind instrument 26, or an array of push-buttons 27. Note that FIG. 2 is meant to be illustrative, and there are many more kinds of input peripherals that can be described by one skilled in the art. For example, a motion detector that attaches to the body could be used as an input peripheral.

Figure 3:
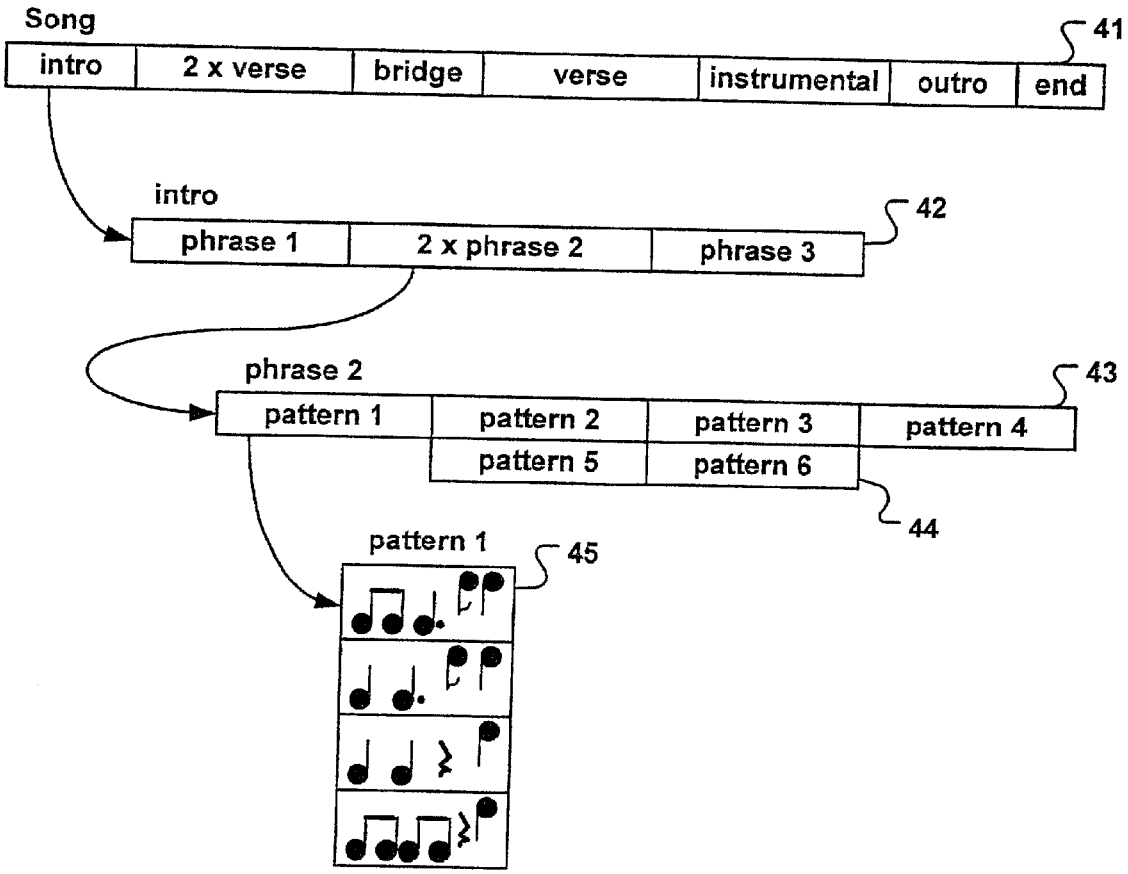
FIG. 3 is a block diagram of a representative example showing the from of the hierarchical structure used to represent a song.

A song used with the music system can be described in terms of a hierarchical music data structure. FIG. 3 shows an example of the hierarchical music data structure, describing what a player is supposed to play. This data structure representation mimics the thought process of a musician in describing a piece of music. Each hierarchical music data structure has two basic components: structural components and patterns. A plurality of structural components is use to describe a song 41 and a plurality of patterns are used to form the structural components. For example, FIG. 3 shows the song description as having an intro, followed by two identical verses, followed by a bridge, followed by a verse, followed by an instrumental, followed by an outro, finishing with an ending. Each of these structural components has a further decomposition in the form of a pattern, such as the one illustrated by pattern 45 in FIG. 3.

The hierarchical music data structure can also include other decompositions or data arrangement structures, as needed, to describe a song. For example, each structural component can be formed from a plurality of phrases. FIG. 3 shows an example of the decomposition of the intro 42 as a series of phrases: phrase 1, followed by two repetitions of phrase 2, followed by phrase 3. Each phrase can then be formed by a plurality of patterns. Note that FIG. 3 is meant to illustrate the hierarchical nature of the data definition, and omits a large amount of detail that can be filled in by one skilled in the art.

Each structural component and each pattern within the hierarchical music data structure can include a plurality of alternative structural components and a plurality of alternative patterns, respectively. These alternative structural components and alternative patterns are used to provide variety within a song, such that a user can play a single song a number of times without producing the same musical patterns in the song each time played. For example, the pattern 45, shown in FIG. 3, has four different rhythmic decompositions or alternative patterns. Each of the alternative patterns are valid in the context of the music, with each having different rhythmic properties. When a user plays along with a song, such as the song shown in FIG. 3, one of the four alternative patterns, for the portion of the song shown in FIG. 3, is accessed. Each time the user plays the song, a different alternative pattern can be accessed at the portion shown, to provide some variety in the music and prevent the song from becoming too repetitious.

The alternative structural components and alternative patterns can also be used to provide different musical styles within a song. For example, the structural components can include alternative components in rock, jazz, country and funk styles. The alternative structural components and alternative patterns can also be used to provide various difficulty levels within the song. Increasing difficulty levels can challenge a user to become more proficient at operating his peripheral and following the hierarchical music data structure.

For example, FIG. 3 shows two difficulty levels for phrase 2: first level or easy level 43 and a second level or difficult version 44 where the second level is more difficult than the first level. The first level 43 is made up of patterns in the sequence of pattern 1, pattern 2, pattern 3, pattern 4, and the second level 44 is made up of patterns in the sequence of pattern 1, pattern 5, pattern 6, pattern 4, where patterns 5 and 6 are more difficult patterns than patterns 2 and 3. The difficulty level that is presented to a user can be determined based upon the user's score or can be determined randomly by the processor such as through a randomization algorithm.

FIG. 4 shows the data structure that is used for all of the song elements in FIG. 3 except for the patterns. The "next song element" pointer 61 refers to the next song element in the list of song elements in this particular decomposition. For example, in the decomposition of a song 41 in FIG. 3, the "next song element" pointer of the "instrumental" would reference the "outro". The "repeat count" item 62 tells how many times the element is repeated in an ordinary performance of the piece. The "element length" item 63 indicates how long the element is, measured in musical terms (rather than absolute time). For example, an "element length" item might indicate that this element is four quarter notes in length. The data structure can include a modification data structure used to modify tempo and musical key. The "tempo adjustment" item 64 describes how the tempo varies in this musical element during an ordinary performance of the piece. It is represented by an array 65 of tempo adjustments that indicate the tempo changes in an arbitrary number of places in the song element. The tempo is scaled linearly between the points defined by the array. The "key adjustment" item 66 indicates how the musical key is adjusted for this song element during an ordinary performance of the piece. It describes the offset of the key for the element, in chromatic intervals. The "alternate song element" pointer 67 refers to the next element, if any, in the list of alternate elements that may be selected for this element. If the "alternate song element" pointer 67 is not empty, then the "element index" item 68 defines an index that can be used for selecting one of the alternate elements from the list. For example, the "element index" item 68 might describe the difficulty of this element. Finally, the "definition" pointer 69 refers to the actual definition of the song element. It can either be a pattern, which defines the element completely, or it can be another song element, which provides the next level in the decomposition of the song. Note that FIG. 4 is meant to illustrate the concepts of the design of the song element data structure, and many different detailed data structure implementations could be described by one skilled in the art.

Figure 5:
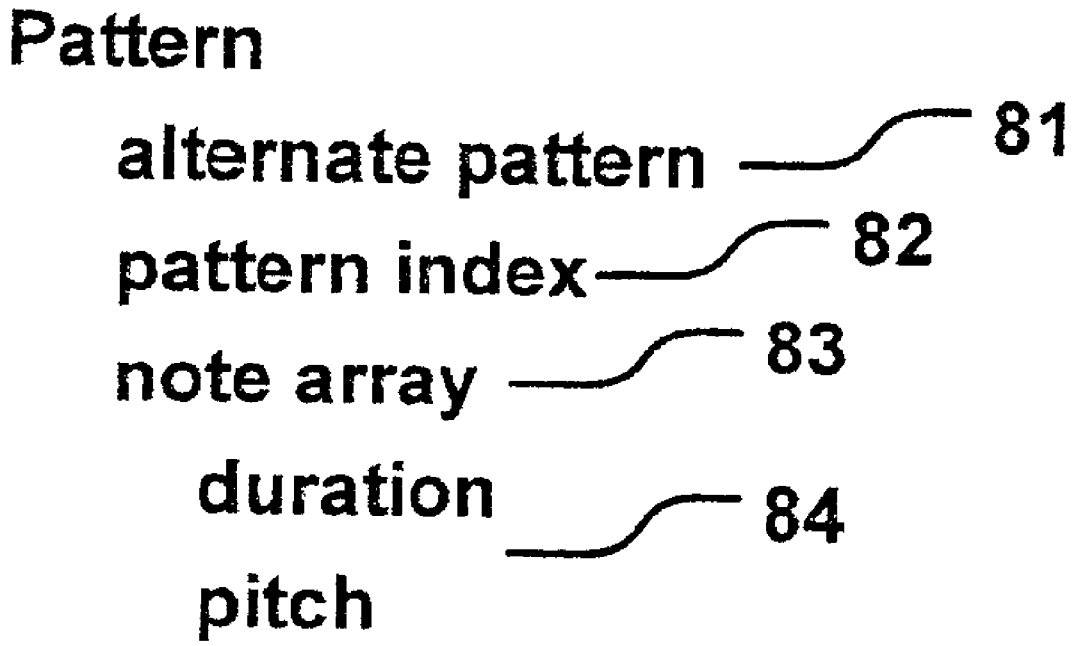
FIG. 5 illustrates the data structure for a pattern.

FIG. 5 shows and example of the data structure that is used to describe a pattern. The "alternate pattern" pointer 81 refers to the next pattern, if any, in the list of alternate patterns that may be selected for this pattern. If the "alternate pattern" pointer 81 is not empty, then the "pattern index" item 82 defines an index that can be used for selecting one of the alternate patterns from the list. For example, the "pattern index" item 82 might describe the difficulty of this pattern. The "note array" item 83 is a sequential list of notes that define this pattern. Each entry 84 in the "note array" 83 contains a duration and a pitch to describe the note. Note that FIG. 5 is meant to illustrate the concepts of the design of the pattern data structure, and many different detailed data structure implementations could be described by one skilled in the art.

Figure 6:
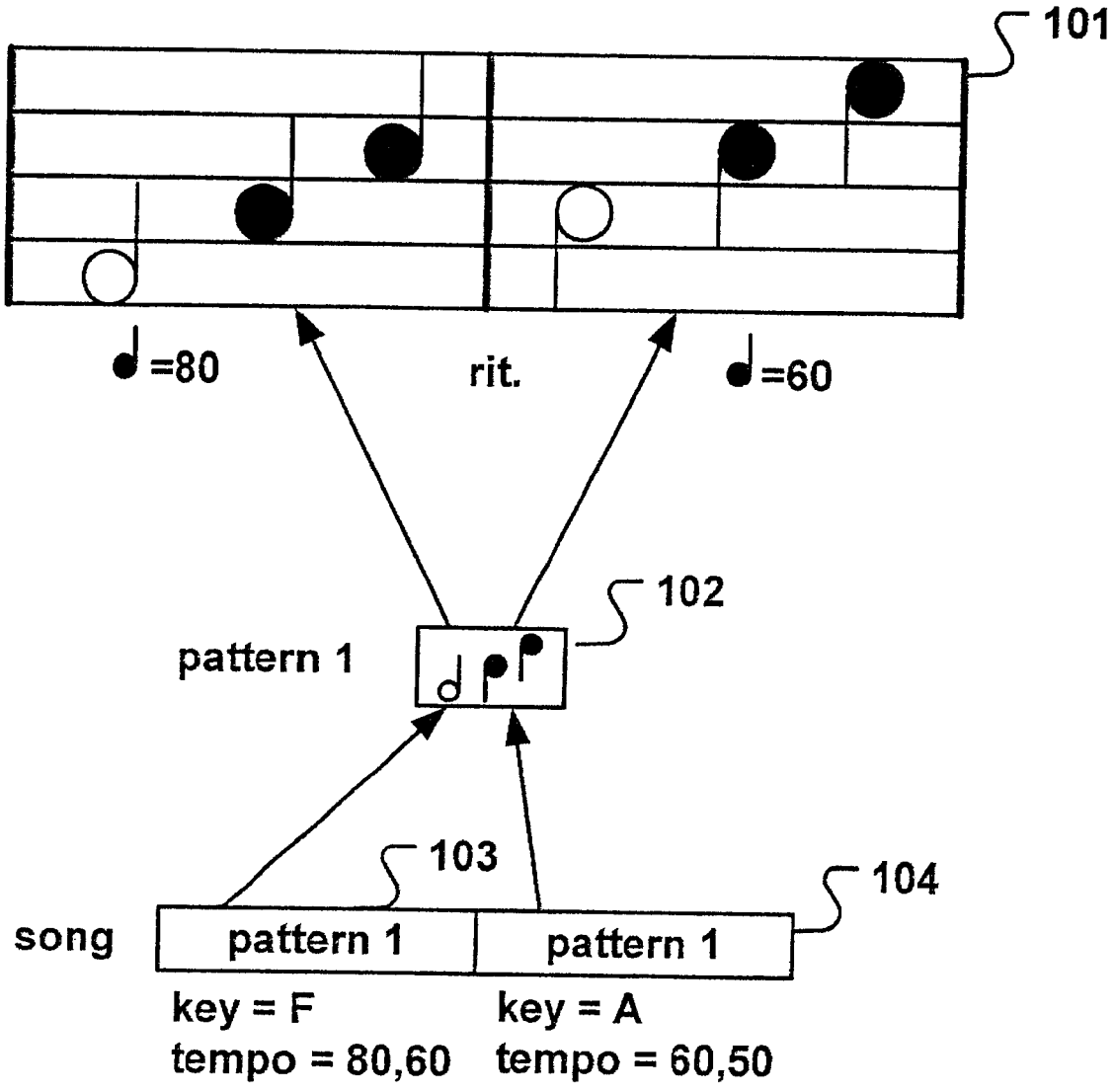
FIG. 6 illustrates the relationship of a pattern to the backing music.

FIG. 6 helps to clarify the relationship between a pattern and its actual performance. For example, a musical performance 101 can contain two measures that are similar in construction, but have different notes with a gradual slowing (ritardando) occurring over the two measures. These two measures can be considered by a musician as two instances of the same phrase, which is represented by a single pattern 102. The varying parameters that change this single pattern 102 are represented by two song elements 103 and 104. The data for song element 103 indicates that the pattern 102 should be played starting on the note "F", with a tempo that starts at 80 beats per minute and linearly slows down to 60 beats per minute, followed by the song element 104. The data in song element 104 indicates that the same pattern 102 should be played again, but this time starting on the note "A", with a tempo that starts at 60 beats per minute (continuing the previous tempo) and linearly slows down to 50 beats per minute. Note that FIG. 6 is meant to be illustrative, and one skilled in the art can describe many variations on the type and value of information used to map patterns to an actual performance.

Figure 7A:
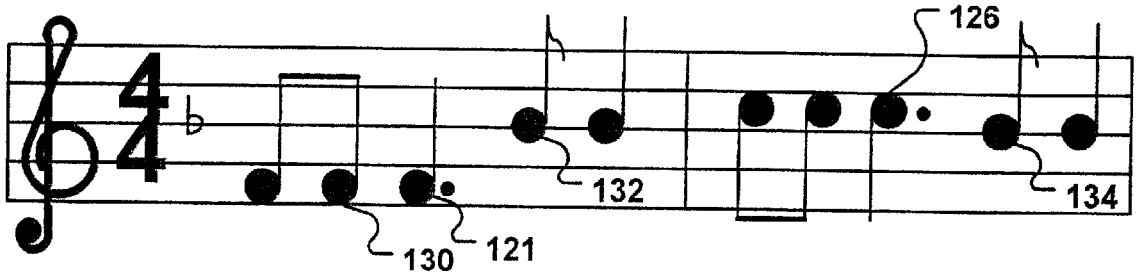
FIGS. 7A, 7B, 7C and 7D illustrate the display that the player follows.
Figure 7B:
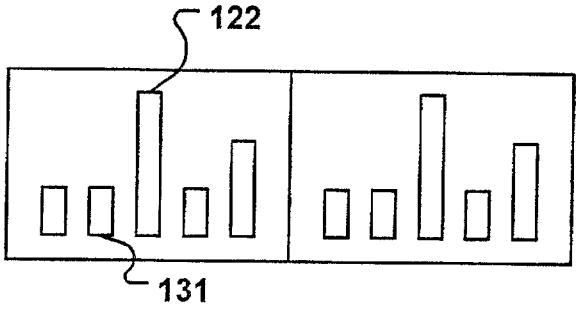
Figure 7C:
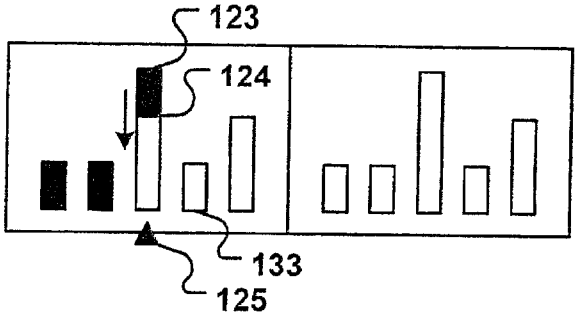
Figure 7D:
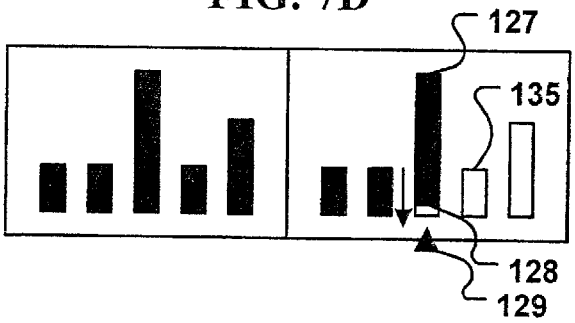

FIGS. 7A, 7B, 7C, and 7D, illustrate the operation of a display that guides the user in activating a peripheral device at appropriate times, according to the hierarchical data structure, during a musical performance. FIG. 7A shows the musical notation for a short section of a musical performance. FIG. 7B shows the display that is presented to the user before the accompanying musical performance is started. The display can include a first axis and a second axis. Each vertical bar in FIG. 7B corresponds to a note in FIG. 7A. For example, the bar 122, along the first axis of the display, corresponds to the note 121, and the length of bar 122, along the second axis of the display, corresponds to the duration of note 121. Since note 121 is three times as long as note 130, the length of bar 122 is three times the length of bar 131 (which corresponds to note 130). FIG. 7C shows the display being presented to the user as the musical performance is in progress. As the musical performance plays, a note indicator 125 is positioned on the display and increments along the first axis to show the player the note to be played. Preferably, the note indicator 125 moves to that note just as it is to be played. For example, in FIG. 7C, indicator 125 is positioned under bar 123 just as note 121 is to be played along with the music. At that time, a duration indicator 124, represented by the shading of bar 123 along the second axis, begins to move downward at a constant velocity. This provides a visual indication of the length of time for a note 121 to be played, and more importantly, provides a "countdown" for the player as to when a subsequent note, such as note 132, should be played. When duration indicator 124 reaches the bottom of bar 123 (meaning that bar 123 is completely filled in), note indicator 125 moves under bar 133, indicating that note 132 should be played. FIG. 7D shows the same display at a later point in the song, when note 126 was the last note played and note 134 is about to be played. Note indicator 129 is positioned under bar 127, and a duration indicator 128 is almost at the bottom of bar 127. As soon as the duration indicator 128 reaches the bottom of bar 127 (meaning that bar 127 is completely filled in), note indicator 129 moves under bar 135, meaning that note 134 should be played. Note that the display shown in FIGS. 7B, 7C, and 7D is simplified to its minimal elements to facilitate understanding, and a more realistic and attractive display can be described by one skilled in the art.

Figure 8A:
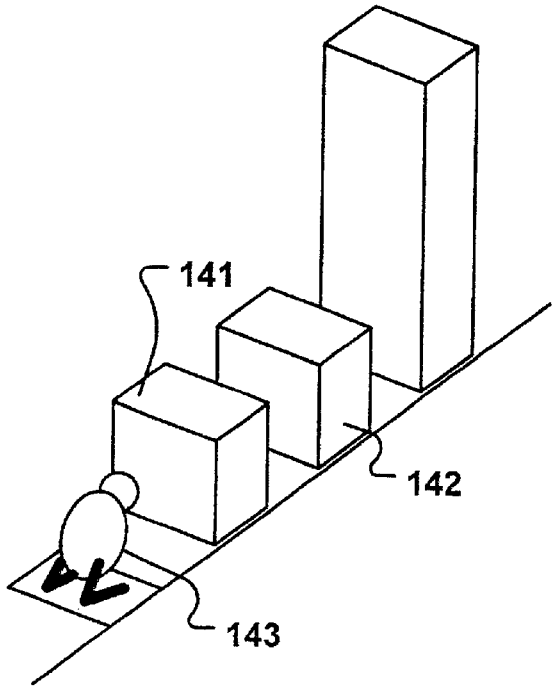
FIGS. 8A and 8B show an alternative display for the player to follow.
Figure 8B:
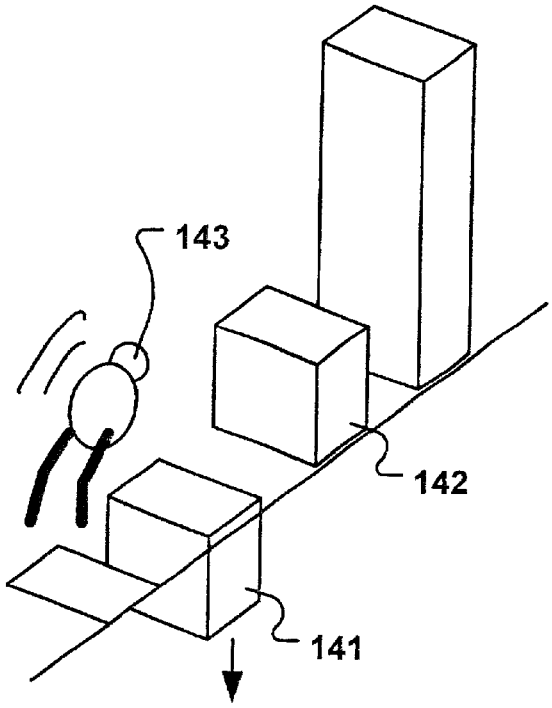

FIGS. 8A and 8B demonstrate that other unique and entertaining display guides can be constructed for entertainment applications. FIG. 8A shows a three-dimensional representation of the bars that represent the notes of the song, along with a stylized frog character 143. When the song starts to play, the bar 141 moves downward at a constant velocity, and when the top of the bar is level with the ground, the player activates the input peripheral, causing the character 143 to jump onto the bar 141. FIG. 8B shows the display when this has just happened, and bar 142 is about to begin to move downward. Note that FIGS. 8A and 8B have been simplified to facilitate understanding, and one skilled in the art can make a much more entertaining and attractive display.

Figure 9:
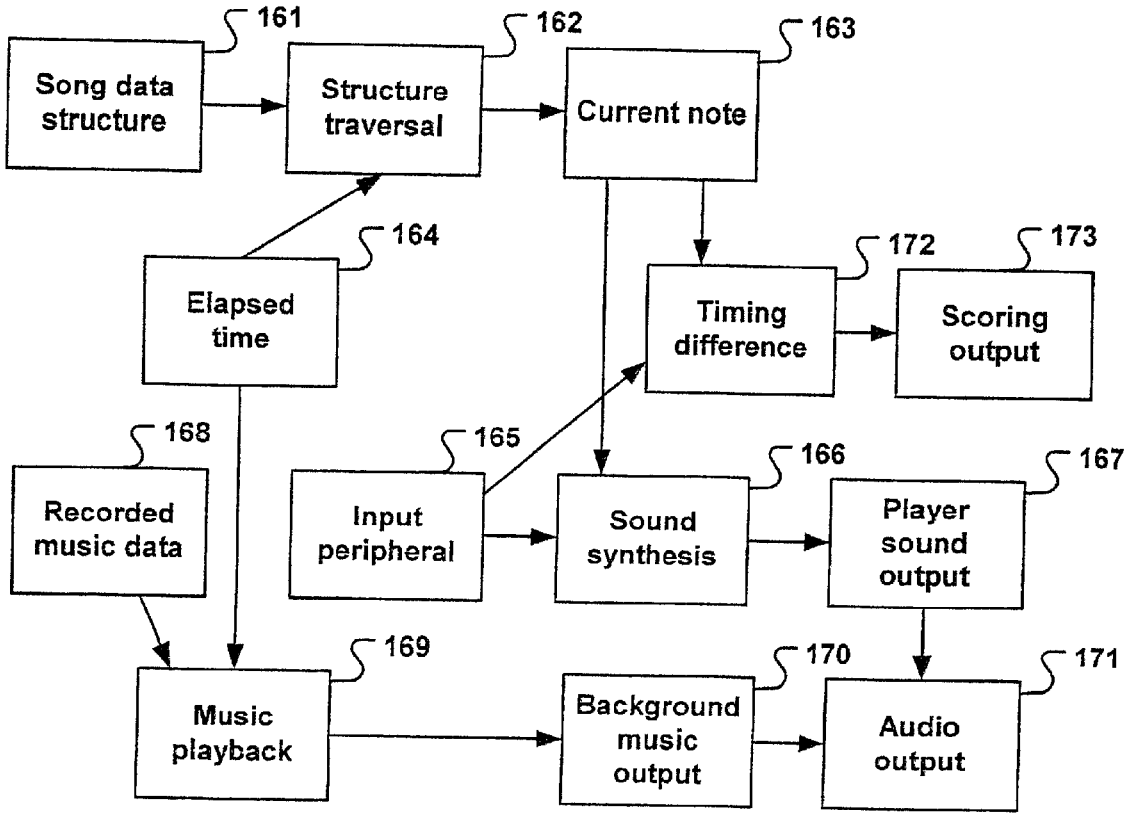
FIG. 9 is a block diagram of the audio generation method.

FIG. 9 shows a block diagram of the sound synthesis. It can be driven by two external inputs, the elapsed time or synchronizer 164 and signals from the input peripheral 165. The digital processor can be used as the synchronizer 164. The elapsed time 164 drives a structure traversal algorithm 162 that traverses the hierarchical song data structure 161 (as shown in FIG. 3) to keep track of the current note 163. This synchronizes the processor to the prerecorded music track. The elapsed time 164 also drives a music playback algorithm 169, which uses recorded music data 168 to play the background music 170 that the player listens to and follows. The input peripheral 165 generates signals that select the current note 163 into the sound synthesis unit 166. The sound synthesis unit 166 can be internal to the computing device or can be implemented external to the computing device, such as by connecting the computing device to an external keyboard synthesizer or synthesizer module, for example. As a result, the sound synthesis unit 166 generates the player's output 167, which is mixed with the background music output 170 to create the final resulting audio output 171. At the same time, a timing difference 172 is applied to compare the player's performance, generated by the input peripheral 165, to the ideal performance, generated as the current note 163. This difference is used to drive the scoring algorithm 173. Note that FIG. 9 shows the overall design of the method used for generating the sound and scoring, and one skilled in the art could fill in the details in many different ways, with many different extensions.

Figure 10:
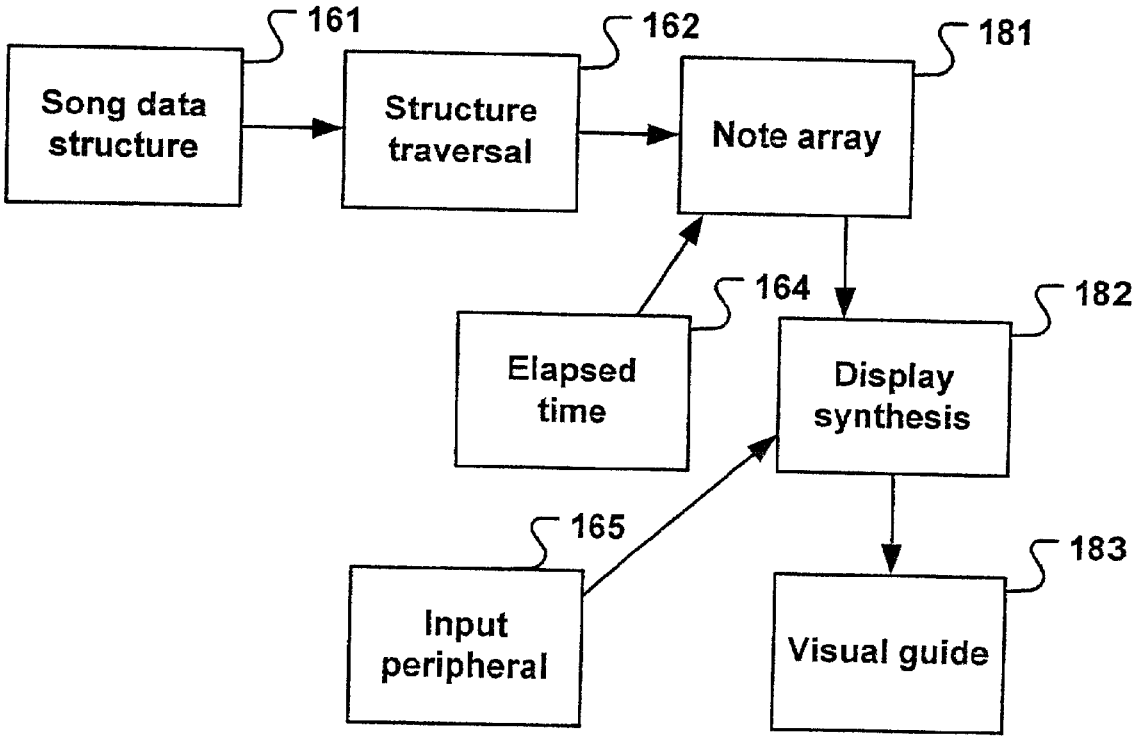
FIG. 10 is a block diagram of the display generation method.

FIG. 10 shows a block diagram of the generation of the visual guide. It is driven by external input from the elapsed time 164. This causes a request to fill the note array 181, which in turn uses the structure traversal algorithm 162 to traverse the hierarchical song data structure 161 to fill the note array 181 with the note values for the next period of time in the display. The display synthesis 182 uses information in the note array 181 to create the visual guide 183 for the player to follow. As the player uses the input peripheral 165 to play along with the song, the display synthesis 182 incorporates the signals from the input peripheral 165 into the display to provide feedback as to how accurately the player played the note. Note that FIG. 10 shows the overall design of the method used for generating the visual display, and one skilled in the art could fill in the details in many different ways, with many different extensions.

Figure 11:
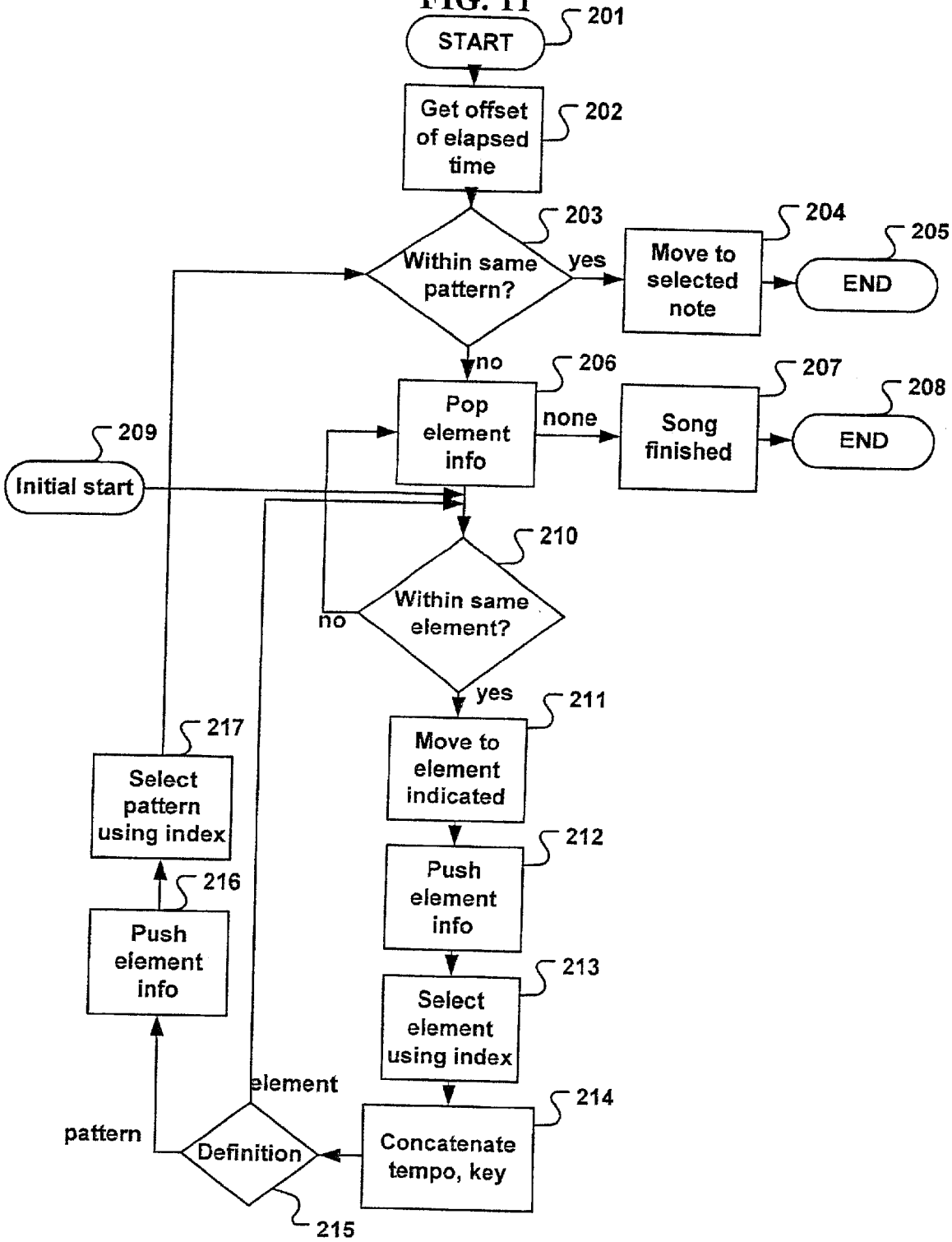
FIG. 11 is a flowchart of the algorithm for traversing the hierarchical structure of a song.

FIG. 11 shows the process of traversing the hierarchical song data structure. Assuming that the song is already in progress, the process starts at step 201. Step 202 calculates the time offset between the current time and the last time the algorithm was used. Step 203 checks to see whether this offset is within the current pattern, using the start time and length associated with the pattern. If the offset is within the same pattern, step 204 simply moves to the correct note within that pattern and sets that as the current note. Then the process ends at step 205. If the offset is not within the current pattern, step 206 pops the song element information off a stack, effectively moving back up in the hierarchy. If the stack is empty, then step 207 indicates that the song is finished and ends the process at step 208. If not, step 210 uses the information popped from the stack to determine whether the offset is within the song element (this determination is made using the start time of the element and its length, which were popped from the stack). If the offset is past the end of this element, the process returns to step 206 to pop another set of information from the stack and move up further in the hierarchy. If the offset is within this element, step 211 moves to the element indicated by the offset. Step 212 then pushes information about the element onto the stack, including the start time of the element and its length. Step 213 selects which element to use for descending into the hierarchy, if there are multiple elements from which to choose. Step 214 concatenates the tempo and key information from the element onto the current values. Step 215 checks to see whether the definition of the element is a pattern or another element. If it is another element, the process returns to step 210 to continue working through the hierarchy. If it is a pattern, then the bottom level of the hierarchy has been reached, so step 216 pushes the current element information onto the stack, and step 217 selects which pattern to use for descending into the hierarchy, if there are multiple patterns from which to choose. Then the process returns to step 203 to process the There are several interesting characteristics of the flowchart in FIG. 11 that are worth noting. When the song starts, the algorithm must descend in the hierarchy to the first pattern. This is easily accomplished by starting at step 209, which pushes all the initial element information onto the stack until it descends to the first pattern. Another interesting feature of the algorithm is that it can move through the song quickly with large time increments if necessary, since it quickly moves to the right level in the hierarchy to step to the correct part of the song with only a small number of steps. Note that FIG. 11 has been slightly simplified by omitting the steps required to handle repetition of song elements. This extension is straightforward and obvious to one skilled in the art.

Figure 12:
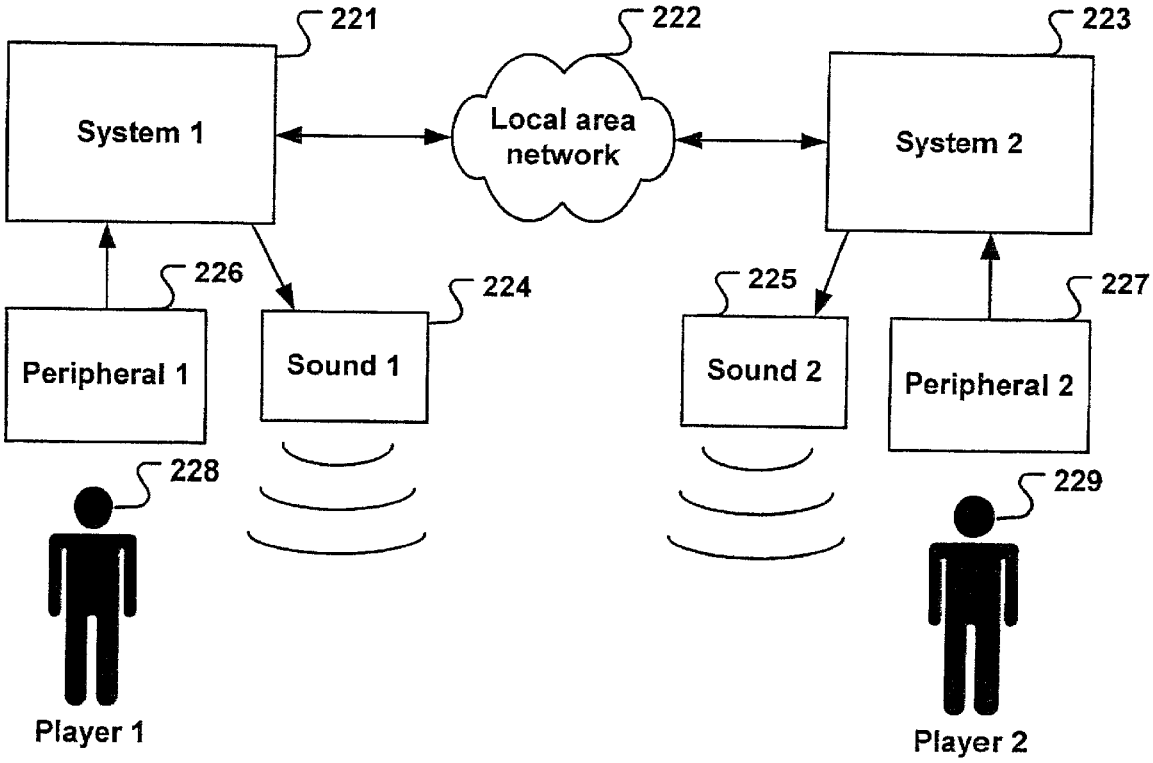
FIG. 12 is a block diagram of the use of the system in a local area network.

Referring to FIG. 12, the configuration for using multiple systems with a local area network has the systems located in relatively close physical proximity. Player 228 uses peripheral 226 to play system 221, which produces sound 224. At the same time, player 229 uses peripheral 227 to play system 223, which produces sound 225. System 221 and system 223 are connected together with local area network 222. They synchronize to the same elapsed time through the network, which has a small enough latency that timing differences are not noticeable to players 228 and 229. Since the sound units 224 and 225 are fairly close together, both players 228 and 229 can hear each other playing as well as themselves. The resulting blend lets the two players work as a "band" in both cooperative and competitive modes. Note that FIG. 12 is meant to illustrate the general concept of a local area network configuration for the system, and one skilled in the art could describe many other detailed implementations of such a configuration.

Figure 13:
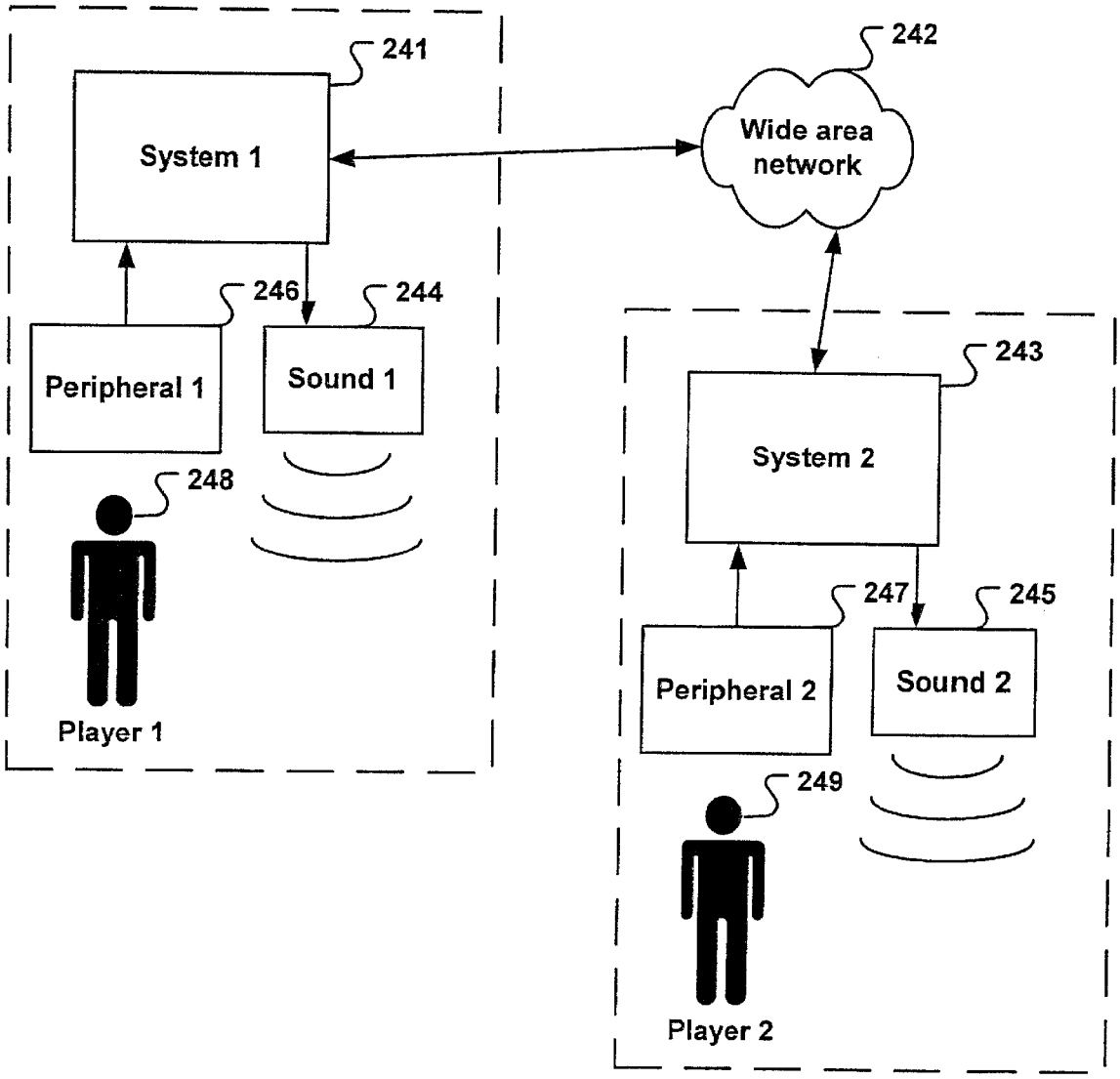
FIG. 13 is a block diagram of the use of the system in a wide area network.

FIG. 13 shows the configuration for using multiple systems with a wide area network. Player 248 uses peripheral 246 to play system 241, which produces sound 244. At the same time, player 249 uses peripheral 247 to play system 243, which produces sound 245. System 241 and system 243 are connected together with wide area network 242. Because of the fact that the systems are separated geographically by some distance, player 248 cannot hear sound 245, and player 249 cannot hear sound 244. Therefore, both sound 244 and sound 245 must generate music representative of the performance of both player 248 and player 249. However, since the network has relatively large latency, it is not practical to try to synchronize the two systems exactly. Moreover, if player 248 and player 249 each play at the same time, each one will perceive that the other player is late by the latency of the network. Finally, the latency of the network is probably not constant, and probably has no maximum, so methods to compensate for fixed latency are ineffective. Note that FIG. 13 is meant to illustrate the general concept of a wide area network configuration for the system, and one skilled in the art could describe many other detailed implementations of such a configuration.

Figure 14:
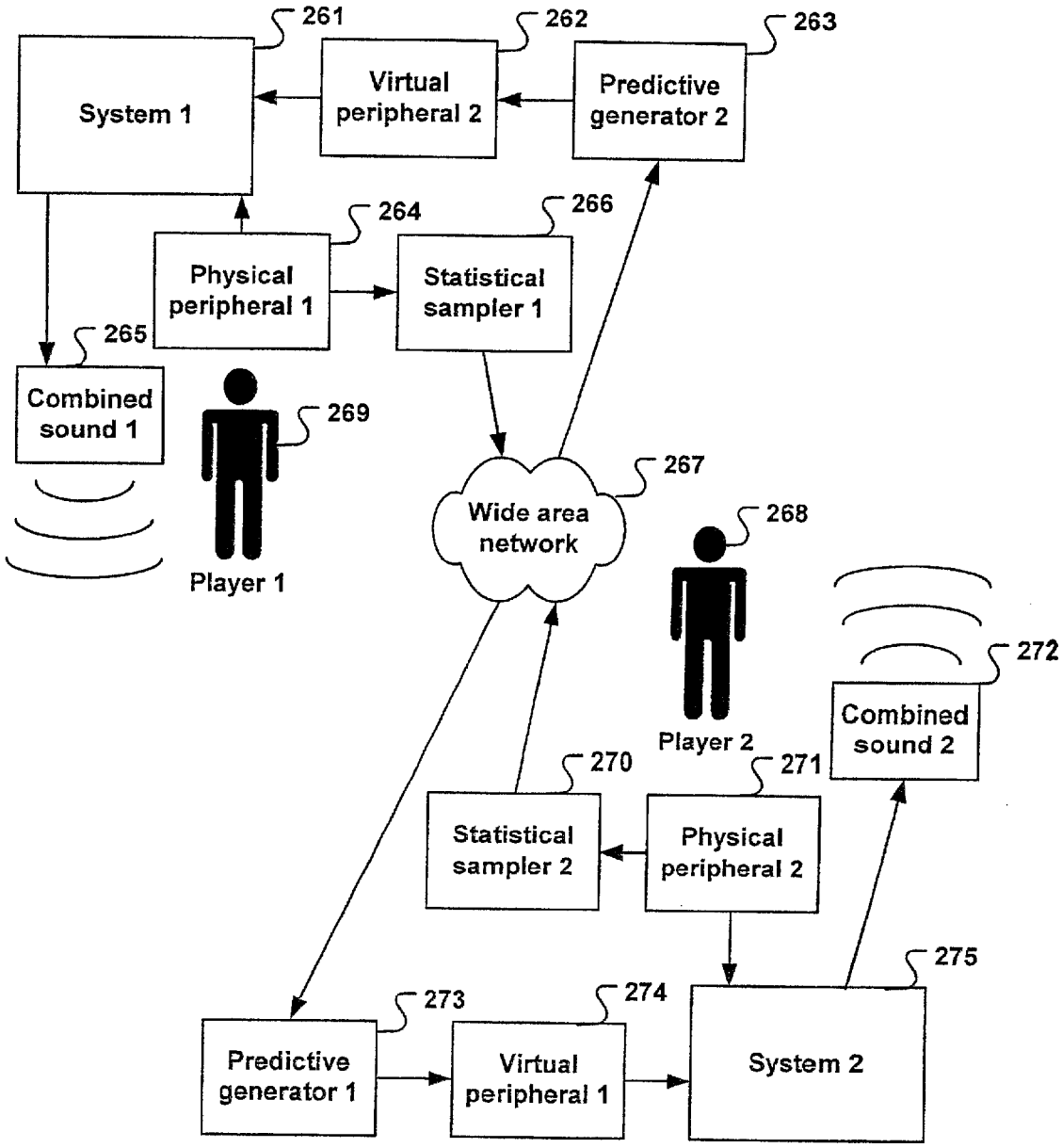
FIG. 14 is a block diagram of the system synchronization in a wide area network.

FIG. 14 illustrates how the systems compensate for the latency in a wide area network. While player 269 is using peripheral 264 to play system 261, generating sound 265, a statistical sampler 266 generates n-th order statistics about the performance of player 269 relative to an ideal performance. These statistics, along with a time stamp, are sent via wide area network 267 to a predictive generator 273, which generates a performance for the current time having the same statistics consistent with those reported by the time stamped data in the past. The resulting performance is used to drive a virtual peripheral 274, which appears as an input to system 275, so that player 268 hears the synthesized performance through sound 272. The synthesized performance, while not exactly the performance played by player 269, has the same n-th order statistics, and in particular, generates approximately the same score. At the same time, player 268 uses peripheral 271 to play system 275, and statistical sampler 270 generates time stamped n-th order statistics of the player's performance relative to an ideal performance. These time stamped data are sent through wide area network 267 to predictive generator 263, where they generate a performance that drives virtual peripheral 262. This performance is processed by system 261 and played through sound 265 where player 269 can hear it. In this way, players 268 and 269 hear a blend of sound that fairly accurately represents their playing together, allowing them to work as a "band" in both cooperative and competitive modes. Note that FIG. 14 is meant to illustrate the technique for allowing multiple players to use a wide area network, and one skilled in the art can fill in many varieties of implementation details.

Figure 15:
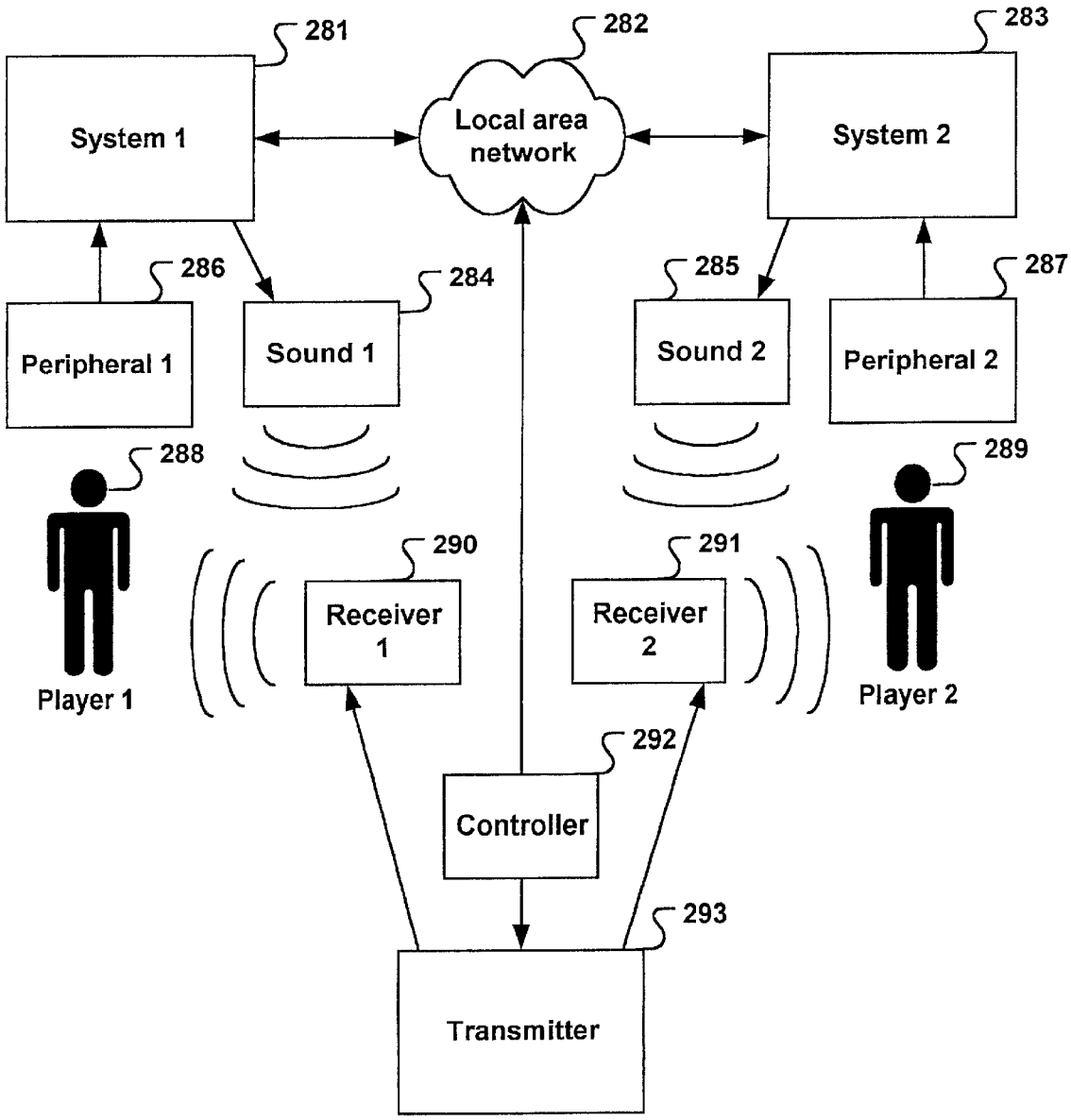
FIG. 15 is a block diagram of the system in a wide area network with a broadcast dia for the background music.

FIG. 15 shows a configuration for using multiple systems in a wide area network, where a broadcast medium, such as a television or radio broadcast medium, provides the backing or background music. Player 288 uses peripheral 286 to play system 281, which produces sound 284. At the same time, player 289 uses peripheral 287 to play system 283, which produces sound 285. Controller 292 drives a transmitter 293 to play music, and at the same time provides synchronization information to system 281 and system 283 through a wide-area network 282. Note that this can be done reliably through public networks with wide or variable latency, using well-known network time protocols. Receiver 290 uses the broadcast signal from the transmitter 293 to provide background music to player 288, and receiver 291 uses the same broadcast signal from the transmitter 293 to provide background music to player 289. Player 288 hears the resulting audio mix from sound 284 and receiver 290, and player 289 hears the resulting audio mix from sound 285 and receiver 291. As a result, the two players can compete against each other, even though they are separated by a relatively large geographical area. Note that FIG. 15 is meant to illustrate the general concept of a broadcast configuration for the system, and one skilled in the art could describe many other detailed implementations of such a configuration.

Many variations can be made to the embodiment described above, including but not limited to, the following embodiments.

The computing device can be a stand alone or embedded system, using devices separately acquired by the player for the display, peripheral, sound, storage, and/or network components. The memory can be integrated into an embedded implementation of the computing device.

Nearly any kind of peripheral can be used to provide rhythmic input. The peripherals described above are only examples, and many others could be described by one skilled in the art.

Many variations of the display used to guide the player incorporating the fundamental elements described above could be created by one skilled in the art. The illustrations contained in the figures are meant merely to be representative.

The predictive algorithm described for driving the virtual peripheral, which uses the n-th order statistics of the player's performance relative to an ideal performance, is only an example. Many other kinds of predictive algorithms could be described by one skilled in the art.

While this invention has been particularly shown and described with references to preferred embodiments thereof, it will be understood by those skilled in the art that various changes in form and details may be made therein without departing from the scope of the invention encompassed by the appended claims.

What is claimed is:

1. A music system comprising:

a hierarchical music data structure representing music being played by a user, the hierarchical structure comprising patterns, at least one of the patterns further comprising a plurality of alternative patterns;

a digital processor selecting the patterns from the hierarchical structure, the digital processor dynamically varying the music being played by selecting one of the plurality of alternative patterns of the at least one pattern;

a display guiding the user in activating a peripheral according to the selected patterns;

a peripheral generating signals in response to activation by the user;

the digital processor receiving the signals from the peripheral; and an audio synthesizer being driven by the digital processor based on the received signals and producing an audio output corresponding to the selected patterns.

2. The music system of claim 1 wherein:

the hierarchical structure comprises structural components, the structural components corresponding to sequences of patterns, at least one of the structural components further comprising a plurality of alternative structural components;

the digital processor selecting the structural components from the hierarchical music data structure, the digital processor further selecting the patterns from the sequences of patterns corresponding to the selected structural components; and the digital processor dynamically varying the music being played by selecting one of the plurality of alternative structural components of the at least one structural component.

3. The music system of claim 1 wherein each of the plurality of alternative patterns is associated with a difficulty level.

4. The music system of claim 3 further comprising:

a scoring algorithm, the scoring algorithm generating a score based upon a correspondence between the signals generated by the user's activation of the peripheral and the selected patterns; and the digital processor selecting one of the plurality of alternative patterns having a difficulty level corresponding to the score.

5. The music system of claim 1 further comprising:

a randomization algorithm, the randomization algorithm determining a pattern index; and the digital processor selecting one of the plurality of alternative patterns according to the pattern index.

6. The music system of claim 2, wherein the structural components comprise a modification data structure defining a musical adjustment.

7. The music system of claim 6 wherein the modification data structure defines a tempo adjustment.

8. The music system of claim 6 wherein the modification data structure defines a musical key adjustment.

9. The music system of claim 1 further comprising:

a scoring algorithm generating a score based upon a correspondence between the signals generated by the user's activation of the peripheral and the selected patterns; and the digital processor selecting one of the plurality of alternative patterns according to the score.

10. The music system of claim 1 wherein the display comprises:

a first axis and a second axis;

the first axis displaying successive musical notes from the selected patterns, the first axis comprising a first indicator indicating a current note to be played, the first indicator incrementing along the first axis to each of the successive notes; and the second axis displaying durations for each of the successive musical notes, the second axis comprising a second indicator indicating a duration for the current note, the second indicator moving along the second axis for the duration of the current note.

11. The music system of claim 1 further comprising a local area network allowing for connection of a plurality of music systems.

12. The music system of claim 1 further comprising a wide area network allowing for connection of a plurality of music systems.

13. The music system of claim 12 further comprising a statistical sampler and a predictive generator, the statistical sampler generating n-th order statistics relative to activation of the peripheral, the statistics sent by the wide area network to the predictive generator that generates a performance based on the statistics from the statistical sampler, independent of the latency of the network.

14. The music system of claim 13 further comprising a virtual peripheral connected to the predictive generator such that the predictive generator drives the virtual peripheral to generate a performance.

15. The music system of claim 12 further comprising a broadcast medium for transmission of recorded music data.

16. The music system of claim 1 further comprising:

recorded music data forming accompanying music to which the user plays; and a synchronizer synchronizing the digital processor to the recorded music data.

17. A method of performing music comprising:

providing a hierarchical music data structure representing music being played by a user, the hierarchical structure comprising patterns, at least one of the patterns comprising a plurality of alternative patterns;

selecting the patterns from the hierarchical structure, such that the music is dynamically varied by selecting one of the plurality of alternative patterns of the at least one pattern;

guiding the user through a display in activating a peripheral according to the selected patterns;

generating signals by the peripheral in response to activation by the user;

receiving the generated signals from the peripheral; and driving an audio synthesizer based on the received signals to produce an audio output corresponding to the selected patterns.

18. The method of claim 17 further comprising:

providing a plurality of music systems and a local area network; and connecting the plurality of music systems to the local area network, each of the plurality of music systems being synchronized to an elapsed time within the network.

19. The method of claim 17 further comprising:

providing a plurality of music systems, each of the plurality of music systems having a statistical sampler and a predictive generator, and a wide area network;

connecting the plurality of music systems to the wide area network;

activating a peripheral in a music systems;

generating n-th order statistics form the statistical sampler relative to the activation of the peripheral;

sending the statistics through the wide area network to the predictive generators within the remainder of the music systems connected to the wide area network;

generating a performance having the approximately the same statistics as those generated by the statistical sampler; and driving a virtual peripheral to form a musical performance.

* * * * *